US011578597B2

(12) United States Patent
He et al.

(10) Patent No.: US 11,578,597 B2
(45) Date of Patent: Feb. 14, 2023

(54) UNDERGROUND LONGWALL MINING METHOD

(71) Applicant: Beijing Zhongkuang Innovation Alliance Energy Environment Science Academy, Beijing (CN)

(72) Inventors: Manchao He, Beijing (CN); Yajun Wang, Beijing (CN); Jun Yang, Beijing (CN)

(73) Assignee: Beijing Zhongkuang Innovation Alliance Energy Environment Science Academy, Beijing (CN)

( * ) Notice: Subject to any disclaimer, the term of this patent is extended or adjusted under 35 U.S.C. 154(b) by 0 days.

(21) Appl. No.: 17/597,480

(22) PCT Filed: Jul. 22, 2019

(86) PCT No.: PCT/CN2019/097065
§ 371 (c)(1),
(2) Date: Feb. 4, 2022

(87) PCT Pub. No.: WO2021/003771
PCT Pub. Date: Jan. 14, 2021

(65) Prior Publication Data

US 2022/0251952 A1 Aug. 11, 2022

(30) Foreign Application Priority Data

Jul. 9, 2019 (CN) ..... 201910616045.4

(51) Int. Cl.
*E21C 41/18* (2006.01)

(52) U.S. Cl.
CPC ..... *E21C 41/18* (2013.01)

(58) Field of Classification Search
CPC ..... E21C 41/18
See application file for complete search history.

(56) References Cited

U.S. PATENT DOCUMENTS 3,999,804 A * 12/1976 Simpson ..... E21C 41/18 299/11
4,174,135 A * 11/1979 Grenia ..... E21C 41/00 299/11
10,494,924 B2 12/2019 He

FOREIGN PATENT DOCUMENTS

CN 102182460 A 9/2011
CN 104405437 A 3/2015
(Continued)

OTHER PUBLICATIONS

Mine Safety and Health Administration, 30cfr75.350, accessed Jun. 2022 (Year: 2022).*
(Continued)

*Primary Examiner* — Janine M Kreck
(74) *Attorney, Agent, or Firm* — ArentFox Schiff LLP

(57) ABSTRACT

An underground longwall mining method includes drilling a main shaft and an auxiliary shaft from a ground to a coal bed and exploiting in the coal bed first and second connection laneways. The first connection laneway is in communication with the main shaft, and the second connection laneway is in communication with the auxiliary shaft. The method further includes communicating the first and second connection laneways, and using a communication part between the first connection laneway and the second connection laneway as a first open-off cut; and by using a direction of the first open-off cut further away from the connecting line connecting the main shaft and the auxiliary shaft as a first direction, and exploiting by cutting a coal wall in the first direction using a coal mining machine.

8 Claims, 9 Drawing Sheets

(56) References Cited

FOREIGN PATENT DOCUMENTS

| | | | |
|---|---|---|---|
| CN | 105089668 | A | 11/2015 |
| CN | 105240013 | A | 1/2016 |
| CN | 105909295 | A | 8/2016 |
| CN | 106194177 | A | 12/2016 |
| CN | 106761750 | A | 5/2017 |
| CN | 109779686 | A | 5/2019 |
| CN | 109882175 | A | 6/2019 |
| EP | 2801697 | A1 | 11/2014 |

OTHER PUBLICATIONS

Mine Safety and Health Administration, 30cfr75.380, accessed Jun. 2022 (Year: 2022).*

China National Intellectual Property Administration, International Search Report and Written Opinion dated Apr. 1, 2020 issued in PCT Application No. PCT/CN2019/097065.

China National Intellectual Property Administration, First Search Report issued in Chinese Patent Application No. 2019106160454.

* cited by examiner

UNDERGROUND LONGWALL MINING METHOD

CROSS-REFERENCE TO RELATED APPLICATIONS

This application is a National Phase of PCT/CN2019/097065, filed on Jul. 22, 2019, which claims priority to Chinese Patent Application No. 201910616045.4, filed on Jul. 9, 2019, the disclosures of each of which are hereby incorporated by reference in their entireties.

TECHNICAL FIELD

The present disclosure relates to the technical field of mining, and particularly relates to an underground longwall mining method, especially a pit designing method without laneway excavation.

BACKGROUND

Underground coal exploitation usually requires to excavate from the ground to underground a series of shafts and laneways, including a main shaft, an auxiliary shaft, an exploiting laneway, a preparatory laneway, a stopping laneway and so on. In order to protect those laneways, during the mining, it is further required to leave a large quantity of laneway protecting coal pillars adjacent to the laneways, to prevent the laneways from being destroyed by mining actions and roof motions. Such a mining approach has been developed in China for decades, and currently has become the most extensively applied exploiting mode. It has made a huge contribution to the coal exploitation of China, but has many problems:

(1) The laneway protecting coal pillars left adjacent to the shaft station, the exploiting laneway, the preparatory laneway and the stopping laneway causes a serious resource waste and a serious harm to the environment.

(2) The large laneway excavation amount causes a high production cost. The underground exploitation usually requires to excavate a large quantity of laneways, including an exploiting laneway, a preparatory laneway, a stopping laneway and so on.

(3) Laneway accidents frequently happen. According to statistics, among coal-mine accidents, laneway accidents account for 91%, wherein those in the working-face stopping laneways account for approximately 90% of the laneway accidents.

(4) The shaft construction requires a long period and a huge investment. In order to enable each of the stopping working faces to normally connect, one coal mine is required to be provided with a plurality of excavation working faces, which needs a lot of workers, a high excavation amount, a long excavation time and a high excavation cost, and the alternation between the coal mining and the excavation is tense. The tremendous workload of the excavation causes an extremely long time for the early-stage preparation of coal production, increases the cost of coal production, and wastes a large amount of time and money.

In conclusion, the conventional techniques of coal mining have the problems of a large laneway excavation amount, a long excavation time, a high excavation cost and frequent laneway accidents, and the coal-pillar leaving causes a huge waste of the coal resource.

SUMMARY

The present disclosure provides a pit designing method without laneway excavation, to solve the problems in the prior art that coal mining has a large laneway excavation amount, a long time of shaft construction, a high excavation cost and frequent laneway accidents, and the coal-pillar leaving causes a huge waste of the coal resource.

In order to solve the above technical problems, the present disclosure provides an underground longwall mining method, wherein the method comprises the steps of: drilling a main shaft and an auxiliary shaft from a ground to a coal bed; exploiting in the coal bed a first connection laneway and a second connection laneway, wherein the first connection laneway is in communication with the main shaft, and the second connection laneway is in communication with the auxiliary shaft; communicating the first connection laneway and the second connection laneway, and using a communication part between the first connection laneway and the second connection laneway as a first open-off cut, wherein a direction of the first open-off cut is parallel to a connecting line connecting the main shaft and the auxiliary shaft; by using a direction of the first open-off cut further away from the connecting line connecting the main shaft and the auxiliary shaft as a first direction, exploiting by cutting a coal wall in the first direction using a coal mining machine, to form a first mining face with the first direction as an exploitation advance direction; by the coal mining machine, cutting out a first haulageway and a first return airway while cutting the coal wall at the first mining face, and preserving the first haulageway and the first return airway, wherein the first haulageway and the first return airway are located on two sides of the first mining face, the first haulageway is in communication with the main shaft, and the first return airway is in communication with the auxiliary shaft; after the first mining face has been mined to a mining stopping line, leaving a reserved laneway of the first mining face at an end of the first mining face, wherein the reserved laneway of the first mining face is in communication with the first haulageway and the first return airway; after the coal mining at the first mining face has been completed, by using the first haulageway or the first return airway of the first mining face as an open-off cut of a second working face, exploiting at the second working face in a second direction further away from the first haulageway or the first return airway; and exploiting completely all of the second working faces.

Optionally, the second working face is exploited from one side of the first mining face that is located at the first haulageway.

Optionally, the second working face is exploited from one side of the first mining face that is located at the first return airway.

Optionally, the second direction is perpendicular to the first direction.

Optionally, the first haulageway and the first return airway are formed by using a technique of roof-cutting pressure-relieving lane self-formation.

Optionally, the first mining face is two first mining faces, and the two first mining faces are symmetrical with respect to the connecting line connecting the main shaft and the auxiliary shaft.

Optionally, the method comprises, after all of the second working faces have been completely exploited, arranging an open-off cut adjacent to the main shaft, and exploiting in the second direction further away from the main shaft.

Optionally, the method comprises, after all of the second working faces have been completely exploited, arranging an open-off cut adjacent to the auxiliary shaft, and exploiting in the second direction further away from the auxiliary shaft.

Optionally, the method comprises, after all of the second working faces have been completely exploited, arranging an open-off cut around the main shaft or the auxiliary shaft, and exploiting an area encircled by the main shaft, the auxiliary shaft, the first connection laneway and the second connection laneway.

By using the technical solutions of the present disclosure, the underground longwall mining method according to the present disclosure designs the layout of the exploitation of the entire mining area at the very early stage of the shaft construction. After the mineshafts of the pit have been completely exploited, the first connection laneway and the second connection laneway are exploited directly by using the mineshafts, the two connection laneways are communicated to form an open-off cut, and finally the mining is performed. That can eliminate a large amount of laneway excavation, reduce the time of the early-stage preparation of coal production, and advance the time of coal exploitation. Moreover, the present disclosure reduces the cost of coal production, reduces the personnel required by excavation, prevents safety accidents caused by laneway excavation, and saves a large amount of time and money for the entire pit production. The exploiting method can shorten the construction period of the pit, and, furthermore, with the proceeding of the mining, it is made possible that no coal pillar is left in the entire mining area, which can increase the output rate of the pit, save the coal resource, prolong the service life of the pit, and prevent geological disasters such as large deformation of the laneway wall rock, rock burst, coal (rock) explosion, and coal and gas outburst caused by stress concentration over the left coal pillar.

DETAILED DESCRIPTION

The present disclosure will be further described in detail below with reference to the drawings and the particular embodiments, which are not intended to limit the present disclosure.

Referring to FIGS. 1 to 5, according to an embodiment of the present disclosure, there is provided a pit designing method without laneway excavation, i.e., an underground longwall mining method. The method comprises the following steps:

Step 1: drilling a main shaft 1 and an auxiliary shaft 2 from the ground to a coal bed.

Step 2: exploiting in the coal bed a first connection laneway 31 and a second connection laneway 32, wherein the first connection laneway 31 is in communication with the main shaft 1, the second connection laneway 32 is in communication with the auxiliary shaft 2, and the lengths of the first connection laneway 31 and the second connection laneway 32 are preferably 50-100 m.

Figure 1:
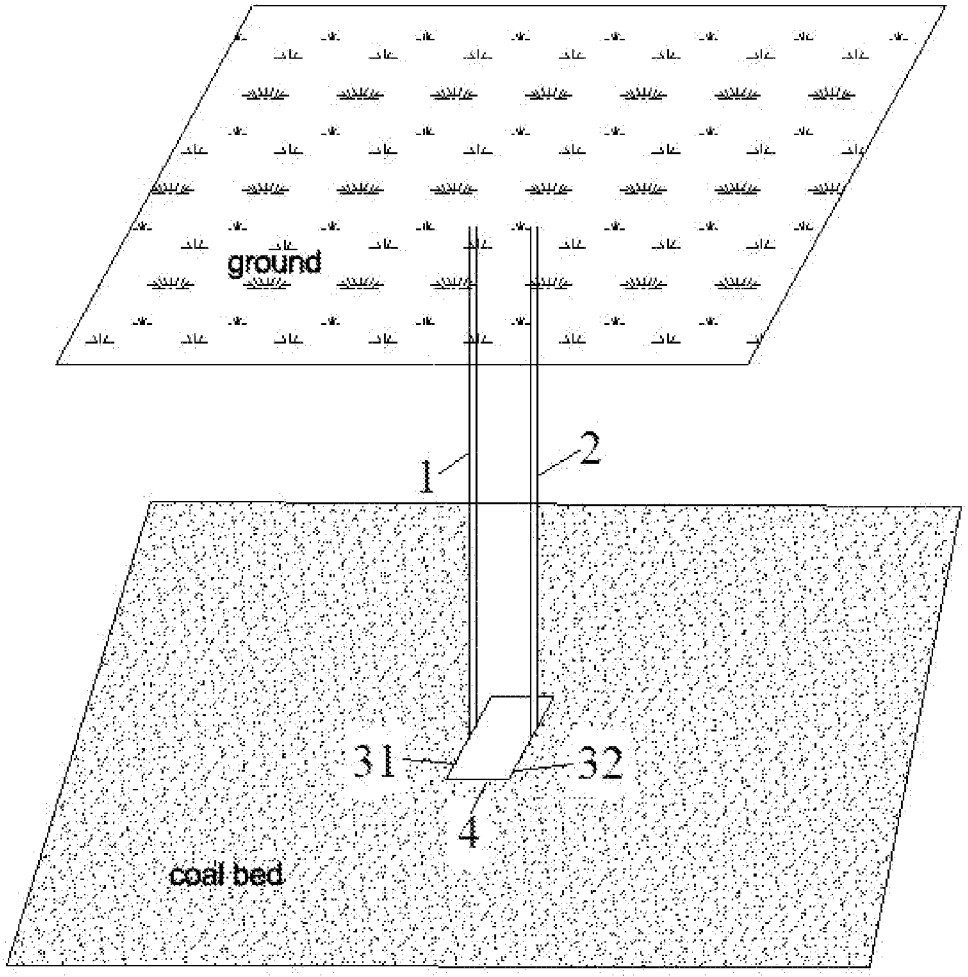
FIG. 1 is a schematic diagram of the formation of the first open-off cut according to an embodiment of the present disclosure.

Step 3: as shown in FIG. 1, communicating the first connection laneway 31 and the second connection laneway 32, and using the communication part between the first connection laneway and the second connection laneway as a first open-off cut 4, wherein preferably, the direction of the first open-off cut 4 is parallel to a connecting line connecting the main shaft 1 and the auxiliary shaft 2.

Figure 2:
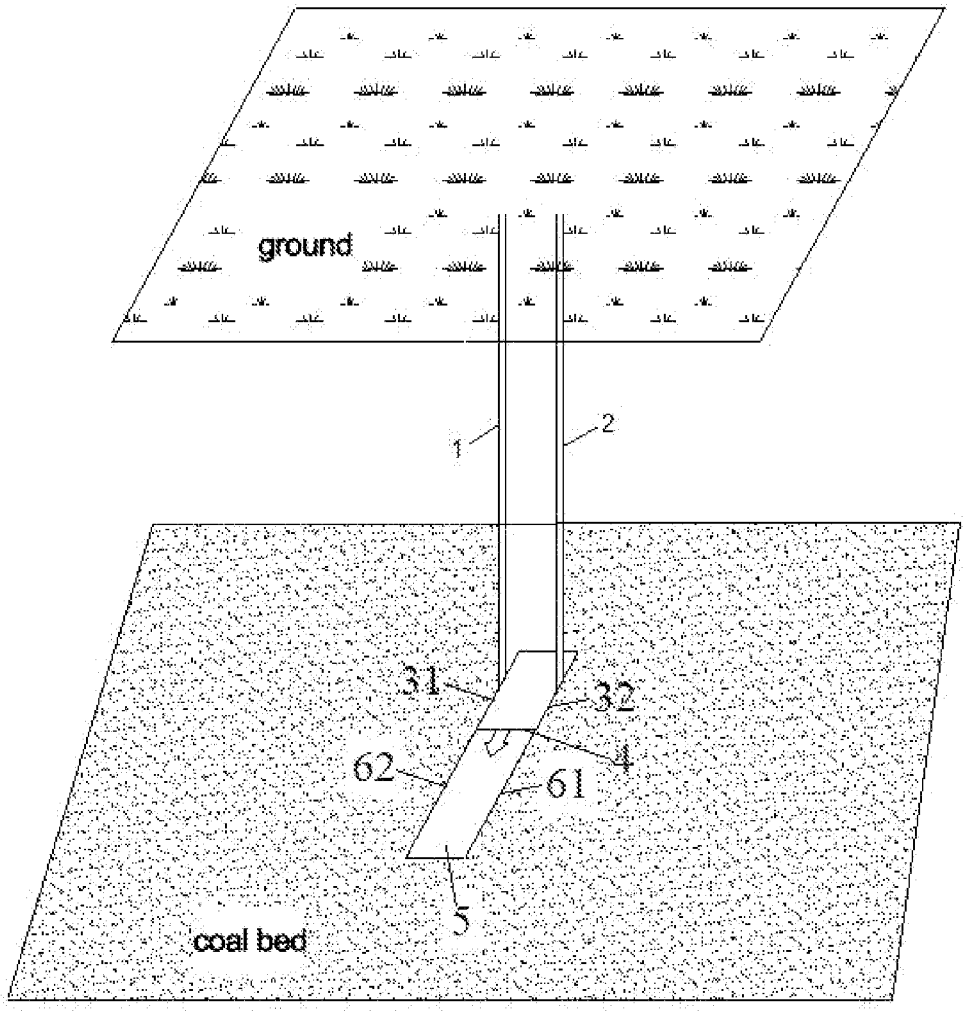
FIG. 2 is a schematic exploitation diagram of the exploitation of a first of the first mining faces according to an embodiment of the present disclosure.

Step 4: as shown in FIG. 2, by using the direction of the first open-off cut 4 further away from the connecting line connecting the main shaft 1 and the auxiliary shaft 2 as a first direction, exploiting by cutting a coal wall in the first direction using a coal mining machine, to form a first mining face 5 with the first direction as the exploitation direction. Referring to FIG. 2, the end of the first mining face 5 is the end of the coal bed in the first direction; in other words, the first mining face 5 may be exploited to, in the first direction, a position where no coal exists, or to the boundary of the well field.

Step 5: by the coal mining machine, cutting out a first haulageway and a first return airway while cutting the coal wall at the first mining face, and preserving the first haulageway 61 and the first return airway 62 by lane leaving (in other words, the first haulageway 61 and the first return airway 62 are formed by lane leaving during the exploiting operation by the coal mining machine), wherein the first haulageway 61 and the first return airway 62 are located on the two sides of the first mining face 5, the first haulageway 61 is in communication with at least the main shaft 1, and the first return airway 62 is in communication with at least the auxiliary shaft 2.

Step 6: after the first mining face 5 has been mined to a mining stopping line 51, leaving a reserved laneway of the first mining face 5 at the end of the first mining face 5 (the reserved laneway coincides with the position of the mining stopping line 51 in the figure), wherein the reserved laneway of the first mining face 5 is in communication with the first haulageway 61 and the first return airway 62 respectively. By using the coal mining machine, the laneway space is cut out during the coal mining, and, by using the techniques such as roof slitting and constant-resistance large-deformation anchor-cable supporting protection, the laneway space is preserved, to form the first haulageway 61 and the first return airway 62 that are in communication.

Step 7: after the exploitation at the first mining face 5 has been completed, by using the first haulageway 61 or the first return airway 62 of the first mining face 5 as an open-off cut of a second working face 7, exploiting at the second working face 7 in a second direction further away from the first haulageway 61 or the first return airway 62.

Figure 3:
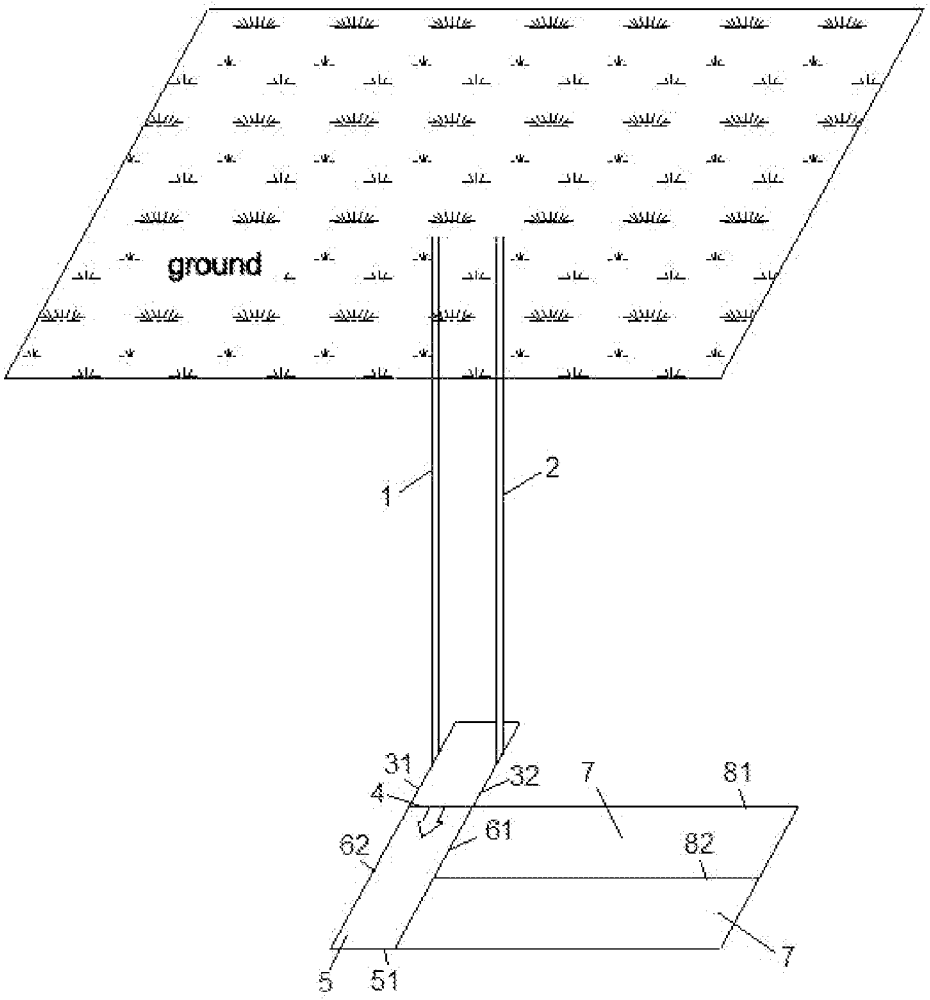
FIG. 3 is a schematic exploitation diagram of the exploitation of the second working face from the first haulageway according to an embodiment of the present disclosure.

Step 8: by the coal mining machine, cutting out a second haulageway 81 and a second return airway 82 while cutting a coal wall at the second working face 7, and preserving the second haulageway 81 and the second return airway 82 by lane leaving (in other words, the second haulageway 81 and the second return airway 82 are formed by lane leaving during the exploiting operation by the coal mining machine), wherein the second haulageway 81 and the second return airway 82 are located on the two sides of the second working face 7, and the second haulageway 81 is in communication with the first haulageway 61, till all of the second working faces have been completely exploited. Referring to FIG. 3, which shows the position relation between the first mining face 5 and the second working faces 7, and the exploitation may be performed according to the layout in FIG. 3.

Figure 4:
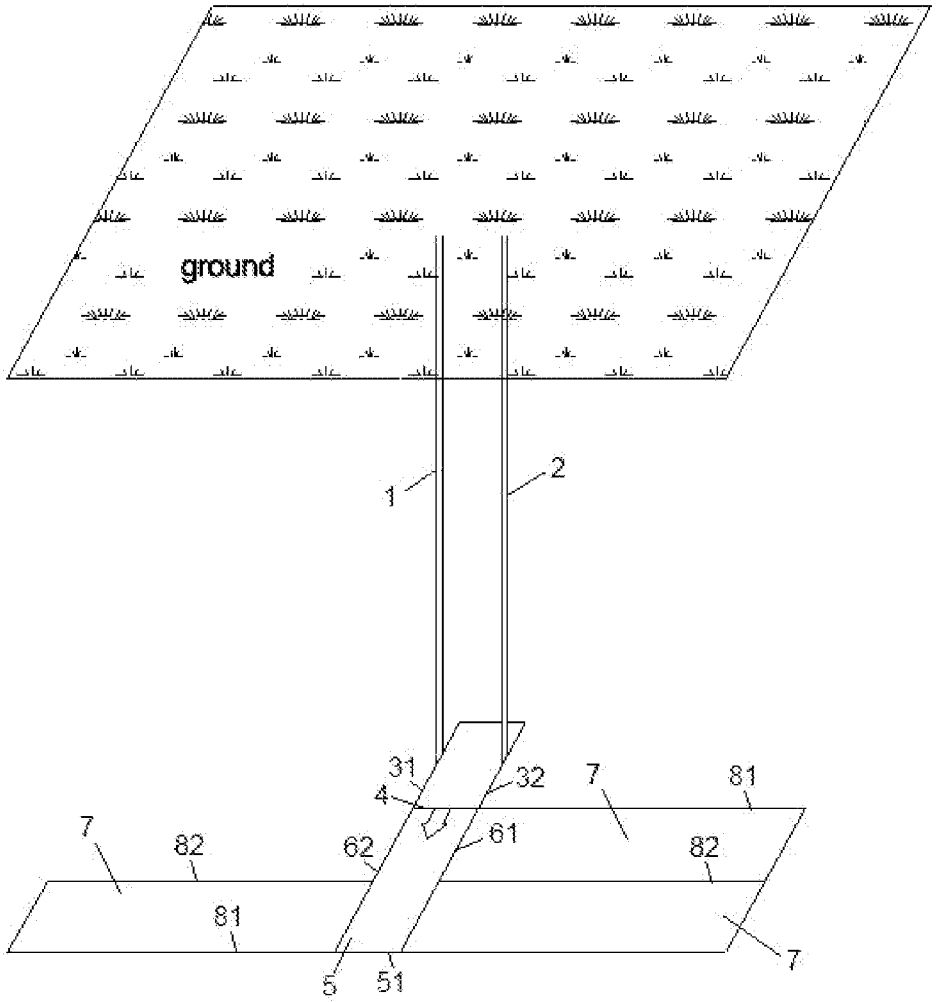
FIG. 4 is a schematic exploitation diagram of the exploitation of the second working face from the first return airway according to an embodiment of the present disclosure.

The second working face 7 is a plurality of second working faces, the plurality of second working faces 7 are sequentially exploited, and, starting from the exploitation of a second of the plurality of second working faces 7, the second return airway 82 of the previous one of the plurality of second working faces 7 is located on one side closer to the next one of the plurality of second working faces 7, and the second return airway 82 of the previous one of the plurality of second working faces 7 is used as the second haulageway 81 of the next one of the plurality of second working faces 7. The haulageway of the previous one of the plurality of second working faces 7 becomes a goaf after the previous one of the plurality of second working faces 7 has been exploited. Starting from the exploitation of a second of the plurality of second working faces 7, the second haulageways 81 of the second working faces 7 are discarded after having been exploited, and are not preserved. Merely the second haulageway 81 of the first of the plurality of second working faces 7 is preserved to communicate the first haulageway 61. Referring to FIG. 4, a plurality of the second working faces 7 are arranged sequentially in the first direction.

Optionally, as shown in FIG. 3, the second working face 7 is exploited from one side of the first mining face 5 that is located at the first haulageway 61. The second direction is perpendicular to the first direction. By using the cooperation between the first direction and the second direction of the first mining face 5, the vast majority of the coal mines in the mining area can be exploited out, which prevents incomplete coal mining to the largest extent, and increases the coal output. In addition, the second working face 7 may also be exploited from one side of the first mining face 5 that is located at the first return airway 62. As shown in FIG. 4, the second working face 7 according to the present disclosure is firstly exploited from the one side of the first haulageway 61, and, after the exploitation has been completed, the second working face 7 on the other side starts to be exploited from the first return airway 62. Certainly, referring to the schematic exploitation diagram shown in FIG. 4, the second working face 7 may be exploited from the two sides (the side of the first haulageway 61 and the side of the first return airway 62) of the first mining face 5 simultaneously, which has a higher exploitation efficiency.

Figure 5:
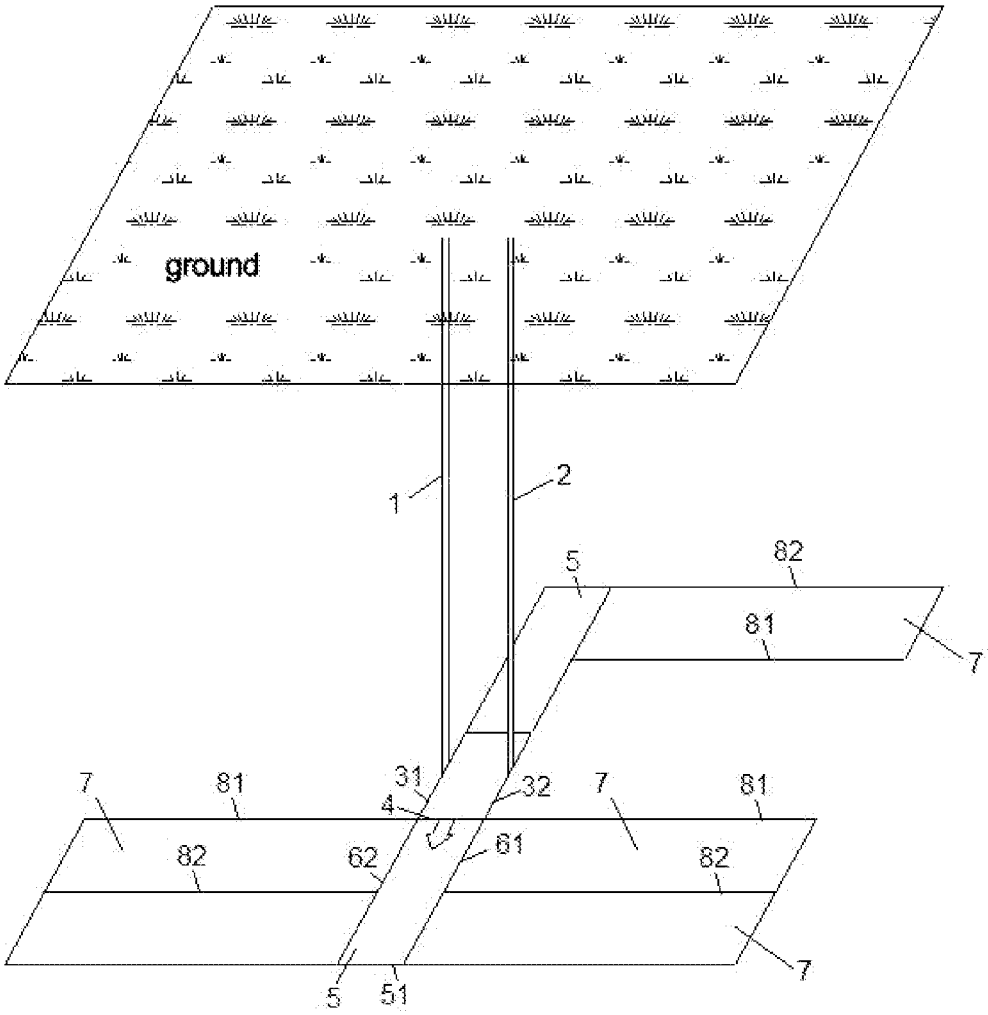
FIG. 5 is a schematic exploitation diagram of the exploitation of a second of the first mining faces according to an embodiment of the present disclosure.
Figure 6:
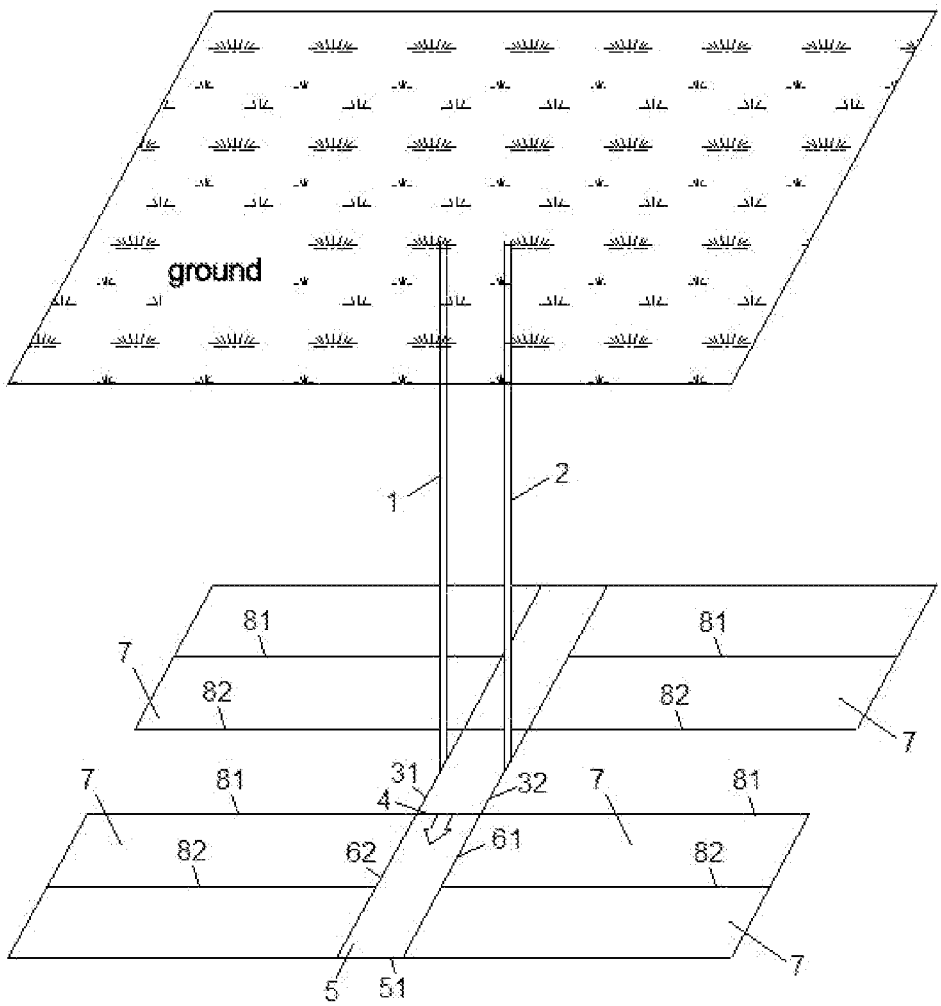
FIG. 6 is a schematic exploitation diagram when all of the second working faces have been completely exploited according to an embodiment of the present disclosure.

As shown in FIG. 5, the first mining face 5 may also be two first mining faces 5, and the two first mining faces 5 are symmetrical with respect to the connecting line connecting the main shaft 1 and the auxiliary shaft 2. The two first mining faces 5 may be sequentially exploited, and may also be simultaneously exploited, which is determined particularly according to the actual situations of the coal bed, and the simultaneous exploitation of the two first mining faces 5 has a higher efficiency. When the two first mining faces are sequentially exploited, after all of the second working faces 7 on the one side of a first of the first mining faces 5 have been completely exploited, a second of the first mining faces 5 and all of the second working faces 7 on the one side of the second of the first mining faces 5 are exploited, till all of the second working faces 7 on the two sides of the two first mining faces 5 have been completely exploited. Alternatively, the two first mining faces 5 may also be simultaneously exploited, the second working faces 7 of the two first mining faces 5 may be simultaneously exploited. FIG. 6 shows a schematic exploitation diagram formed after the first mining faces 5 and all of the second working faces 7 have been completely exploited.

Figure 9:
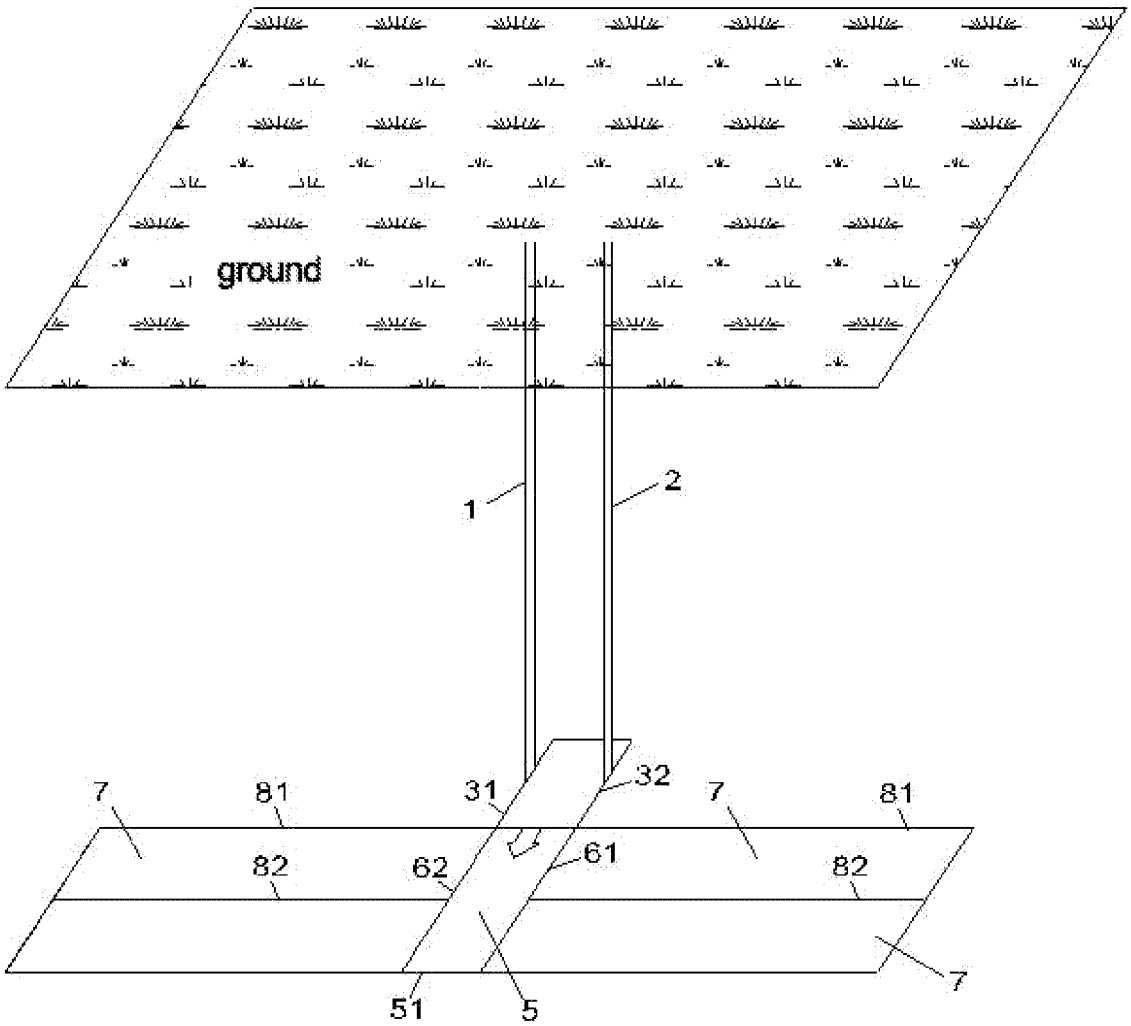
FIG. 9 is a schematic exploitation diagram of the first mining face according to another embodiment of the present disclosure.

Certainly, in another embodiment, the first mining face 5 may also be one. The quantity and the positions of the first mining faces are determined according to the coal bed and the positions of the main shaft and the auxiliary shaft, and are determined particularly according to actual situations. As shown in FIG. 9, when the first mining face 5 is one, the direction of the exploitation of the first mining face is the direction further away from the connecting line connecting the main shaft 1 and the auxiliary shaft 2.

After the second working face 7 has been mined to a mining stopping line, a reserved laneway of the working face is left at the end of the second working face 7, wherein the reserved laneway of the working face is in communication with the second haulageway 81 and the second return airway 82.

Figure 7:
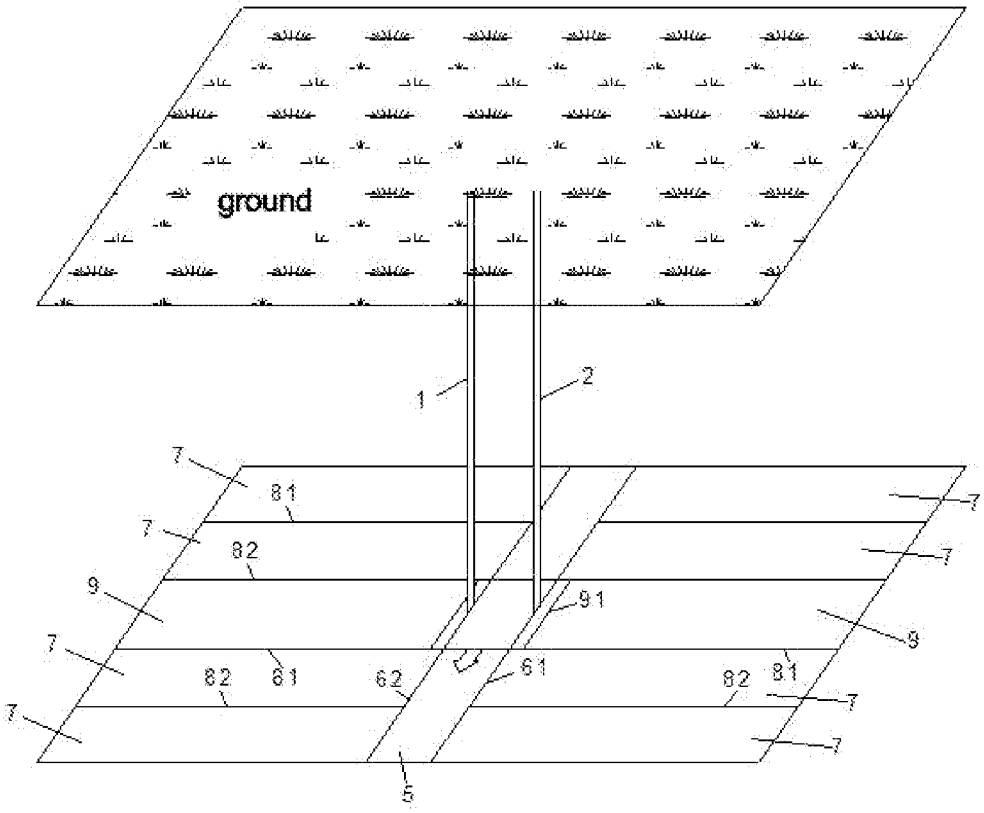
FIG. 7 is a schematic exploitation diagram of the unexploited area according to an embodiment of the present disclosure.

In the mining method according to the present disclosure, further preferably, after all of the second working faces 7 have been completely exploited, an open-off cut 91 is arranged at a position of the main shaft 1 or the auxiliary shaft 2 that faces an un-exploited area 9, and the exploitation is performed in the second direction further away from the main shaft 1 or the auxiliary shaft 2. The particular layout and mining mode may refer to FIG. 7. By using such layout and mining mode, the coal mining facing the un-exploited area 9 can be completed with the main shaft 1 and the auxiliary shaft 2.

Figure 8:
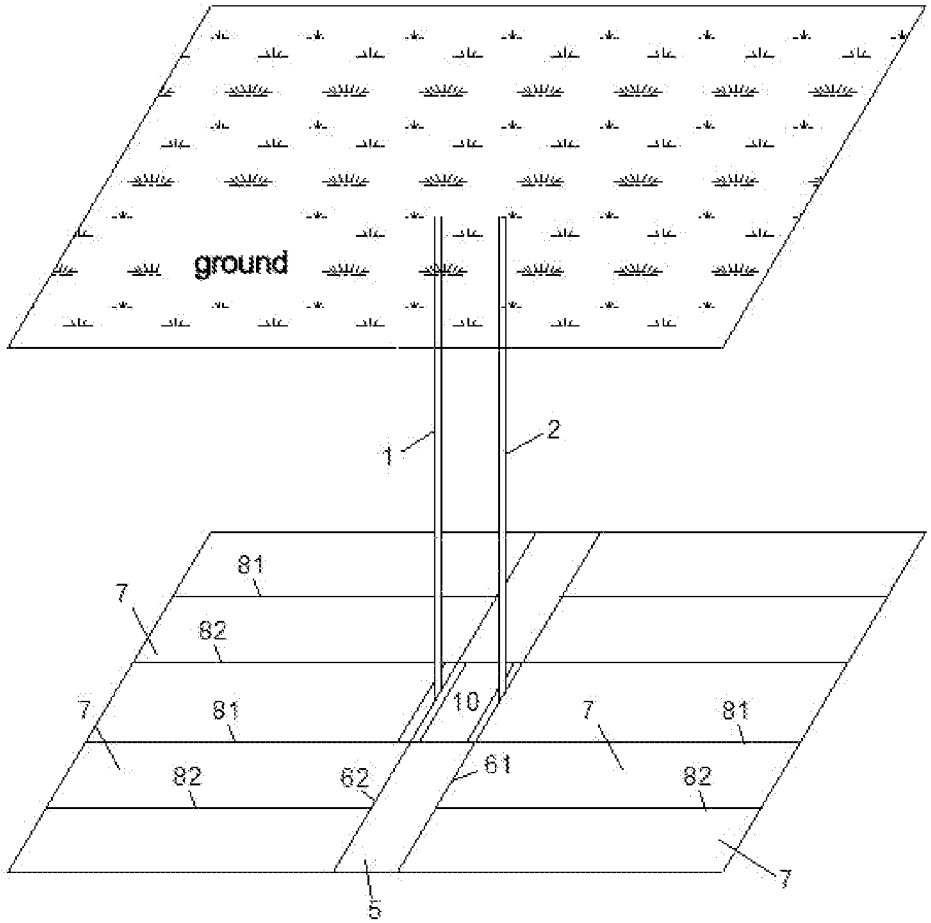
FIG. 8 is a schematic exploitation diagram of the area encircled by the main shaft, the auxiliary shaft and the connection laneways according to an embodiment of the present disclosure.

Referring to FIG. 8, after all of the second working faces 7 have been completely exploited, an open-off cut is arranged around the main shaft 1 or the auxiliary shaft 2, and the area 10 encircled by the main shaft 1, the auxiliary shaft 2, the first connection laneway 31 and the second connection laneway 32 are exploited. The working faces are arranged according to the initial open-off cut adjacent to the mineshafts, and the exploitation is performed by using the conventional modes, at which point the mining at the working faces of the entire mining area is completed, to realize the no laneway excavation in the full mining area.

The underground longwall mining method, i.e., the pit designing method in a full mining area without laneway excavation, according to the present disclosure designs the layout of the exploitation of the entire mining area at the very early stage of the shaft construction. After the mineshafts of the pit have been completely exploited, the first connection laneway 31 and the second connection laneway 32 are exploited directly by using the mineshafts (the main shaft 1 and the auxiliary shaft 2), the two connection laneways are communicated to form the open-off cut, and finally the mining is performed. That can eliminate the excavation, reduce the time of the early-stage preparation of coal production, and advance the time of coal exploitation. Moreover, the present disclosure reduces the cost of coal production, reduces the personnel required by excavation, prevents safety accidents caused by laneway excavation, and saves a large amount of time and money for the entire pit production. The exploiting method can shorten the construction period of the pit, and, furthermore, with the proceeding of the mining, it is made possible that no coal pillar is left in the entire mining area, which can increase the output rate of the pit, save the coal resource, prolong the service life of the pit, and prevent geological disasters such as large deformation of the laneway wall rock, rock burst, coal (rock) explosion, and coal and gas outburst caused by stress concentration over the left coal pillar. As compared with the prior art, the present disclosure has the following advantageous effects:

(1) No laneway is excavated in the entire mining area, which can eliminate the excavation, reduce the time of the early-stage preparation of coal production, and advance the time of coal exploitation. Moreover, the present disclosure reduces the cost of coal production, reduces the personnel required by excavation, prevents safety accidents caused by laneway excavation, and saves a large amount of time and money for the entire pit production.

(2) It is made possible that no coal pillar is left in the entire mining area, which can increase the output rate of the pit, save the coal resource, prolong the service life of the pit, prevent geological disasters such as large deformation of the laneway wall rock, rock burst, coal (rock) explosion, and coal and gas outburst caused by stress concentration over the left coal pillar, and make a huge contribution to the saving of the coal resource.

It should be noted that the terms used herein are merely for the description on the particular embodiments, and are not intended to limit the exemplary embodiments of the present application. As used herein, unless explicitly stated otherwise in the context, the terms in the singular forms are intended to encompass the plural forms. Furthermore, it should also be understood that, when the term "comprise" and/or "include" is used in the description, it indicates the existence of a feature, a step, a process, a device, a component and/or a combination thereof.

It should be noted that the terms "first", "second" and so on in the description, the claims and the drawings of the present application are intended to distinguish similar objects, and are not necessarily used to describe a particular order or sequence. It should be understood that the numbers so used may be interchanged in suitable cases, whereby the embodiments of the present application described herein can be implemented in other sequences than those illustrated or described herein.

Certainly, the above are preferable embodiments of the present disclosure. It should be noted that a person skilled in the art may make various improvements without departing from the basic principle of the present disclosure, wherein those improvements are considered as falling within the protection scope of the present disclosure.

The invention claimed is:

1. An underground longwall mining method, wherein the method comprises steps of:

drilling a main shaft and an auxiliary shaft from a ground to a coal bed;

exploiting in the coal bed a first connection laneway and a second connection laneway, wherein the first connection laneway is in communication with the main shaft, and the second connection laneway is in communication with the auxiliary shaft;

communicating the first connection laneway and the second connection laneway, and using a communication part between the first connection laneway and the second connection laneway as a first open-off cut, wherein a direction of the first open-off cut is parallel to a connecting line connecting the main shaft and the auxiliary shaft;

by using a direction of the first open-off cut further away from the connecting line connecting the main shaft and the auxiliary shaft as a first direction, exploiting by cutting a coal wall in the first direction, to form a first mining face with the first direction as an exploitation advance direction;

cutting the coal wall at the first mining face, cutting out a first haulageway and a first return airway, and preserving the first haulageway and the first return airway, wherein the first haulageway and the first return airway are located on two sides of the first mining face, the first haulageway is in communication with the main shaft, and the first return airway is in communication with the auxiliary shaft;

after the first mining face has been mined to a mining stopping line, leaving a reserved laneway of the first mining face at an end of the first mining face, wherein the reserved laneway of the first mining face is in communication with the first haulageway and the first return airway;

after the coal mining at the first mining face has been completed, by using the first haulageway and/or the first return airway of the first mining face as an open-off cut of a second working face, exploiting at a plurality of second working faces in a second direction further away from the first haulageway and/or the first return airway; and exploiting completely all of the second working faces.

2. The underground longwall mining method according to claim 1, wherein the plurality of second working faces are exploited from one side of the first mining face that is located at the first haulageway.

3. The underground longwall mining method according to claim 1, wherein the plurality of second working faces are exploited from one side of the first mining face that is located at the first return airway.

4. The underground longwall mining method according to claim 1, wherein the second direction is perpendicular to the first direction.

5. The underground longwall mining method according to claim 1, wherein the first mining face is two first mining faces, and the two first mining faces are symmetrical with respect to the connecting line connecting the main shaft and the auxiliary shaft.

6. The underground longwall mining method according to claim 5, wherein the method comprises, after all of the second working faces have been completely exploited, arranging an open-off cut adjacent to the main shaft, and exploiting in the second direction further away from the main shaft.

7. The underground longwall mining method according to claim 5, wherein the method comprises, after all of the second working faces have been completely exploited, arranging an open-off cut adjacent to the auxiliary shaft, and exploiting in the second direction further away from the auxiliary shaft.

8. The underground longwall mining method according to claim 5, wherein the method comprises, after all of the second working faces have been completely exploited, arranging an open-off cut around the main shaft or the auxiliary shaft, and exploiting an area encircled by the main shaft, the auxiliary shaft, the first connection laneway and the second connection laneway.

* * * * *